US009386384B2

(12) United States Patent
Burns

(10) Patent No.: US 9,386,384 B2
(45) Date of Patent: Jul. 5, 2016

(54) HEARING INSTRUMENT TRANSDUCTION APPARATUS USING FERROELECTRET POLYMER FOAM

(71) Applicant: Starkey Laboratories, Inc., Eden Prairie, MN (US)

(72) Inventor: Thomas Howard Burns, St. Louis Park, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 31 days.

(21) Appl. No.: 13/733,802

(22) Filed: Jan. 3, 2013

(65) Prior Publication Data

US 2014/0016804 A1 Jan. 16, 2014

Related U.S. Application Data

(60) Provisional application No. 61/582,669, filed on Jan. 3, 2012, provisional application No. 61/583,027, filed on Jan. 4, 2012.

(51) Int. Cl.
*H04R 25/00* (2006.01)
*H04R 17/02* (2006.01)

(52) U.S. Cl.
CPC ..... *H04R 25/658* (2013.01); *H04R 17/025* (2013.01); *H04R 25/405* (2013.01)

(58) Field of Classification Search
CPC .... H04R 25/00; H04R 25/604; H04R 17/005; H04R 2225/61; H04R 25/405; H04R 1/46; H04R 17/025; H04R 23/006; H01L 41/193; H01L 41/08; H03K 17/962
USPC ..... 381/322–324
See application file for complete search history.

(56) References Cited

U.S. PATENT DOCUMENTS

| | | | | |
|---|---|---|---|---|
| 6,327,370 | B1 * | 12/2001 | Killion | H04R 25/407 381/312 |
| 6,897,390 | B2 * | 5/2005 | Caldwell | A47B 57/00 200/512 |
| 7,142,682 | B2 * | 11/2006 | Mullenborn | H04R 19/005 381/322 |
| 8,022,935 | B2 * | 9/2011 | Hotelling | G06F 3/044 345/156 |
| 8,144,907 | B2 * | 3/2012 | Reithinger | H04R 25/60 381/322 |
| 8,641,919 | B2 * | 2/2014 | Yu et al. | 252/62.9 R |
| 2003/0142843 | A1 * | 7/2003 | Meier | H04R 25/65 381/322 |
| 2008/0292126 | A1 * | 11/2008 | Sacha | H04R 25/02 381/330 |
| 2011/0091058 | A1 * | 4/2011 | Sacha | H04R 25/65 381/321 |

(Continued)

OTHER PUBLICATIONS

Graz et al., "Flexible ferroelectret field-effect transistor for large-area sensor skins and microphones", Aug. 14, 2006, Applied Physics Letters, vol. 89, Issue 7, p. 73501-73503.*

(Continued)

*Primary Examiner* — Curtis Kuntz
*Assistant Examiner* — Ryan Robinson
(74) *Attorney, Agent, or Firm* — Schwegman Lundberg & Woessner, P.A.

(57) ABSTRACT

The present subject matter provides method and apparatus for hearing assistance devices, and more particularly to hearing assistance devices using ferroelectret (also referred to as piezoelectret) polymer foam. Various embodiments include ferroelectret polymer foam on or in the hearing instrument as a microphone. Various embodiments include ferroelectret polymer foam on or in the hearing instrument as a momentary switch sensor.

27 Claims, 1 Drawing Sheet

(56) References Cited

U.S. PATENT DOCUMENTS

| | | | | |
|---|---|---|---|---|
| 2014/0084747 | A1* | 3/2014 | Lovera-Prieto | H01L 41/193 310/300 |
| 2016/0008852 | A1* | 1/2016 | Miyoshi | H04R 17/005 359/444 |

OTHER PUBLICATIONS

Bauer et al. "Ferroelectrets: Soft Electroactive Foams for Transducers", Feb. 2004, Physics Today, vol. 57, Issue 2, p. 37-43.*

* cited by examiner

HEARING INSTRUMENT TRANSDUCTION APPARATUS USING FERROELECTRET POLYMER FOAM

CROSS REFERENCE TO RELATED APPLICATIONS

This application claims the benefit under 35 U.S.C. §119 (e) of U.S. Provisional Patent Application Ser. No. 61/582,669, filed Jan. 3, 2012, and of U.S. Provisional Patent Application Ser. No. 61/583,027, filed Jan. 4, 2012, both of which are incorporated by reference in their entirety herein.

TECHNICAL FIELD

This disclosure relates to hearing assistance devices, and more particularly to hearing assistance devices using ferroelectret polymer foam.

BACKGROUND

Modern hearing instruments contain microphones. Although electret condenser microphones are typically used, MEMS-based microphones are gaining traction. Both types of microphone require that the transduction mechanism is loaded acoustically with small air volumes and also with an orifice that couples one or both of these air volumes to the outside medium. Consequently, each is susceptible to debris contamination, thereby rendering the microphone inoperable. In general, different forms of barriers have been used to protect the microphone, including meshes, screens, membranes, and coatings. Although those approaches may postpone failure from contamination, the microphones themselves will still fail if debris becomes attached onto their transduction mechanism (i.e., onto the membrane of an electret condenser or onto the silicon diaphragm of a MEMS) or if debris occludes an orifice of the acoustical loading. Thus the danger of this failure mechanism is always present.

There is a need, therefore, to integrate a robust microphone technology that would operate after being severely contaminated with debris.

SUMMARY

The above-mentioned problems and others not expressly discussed herein are addressed by the present subject matter and will be understood by reading and studying this specification.

The present subject matter provides method and apparatus for hearing assistance devices, and more particularly to hearing assistance devices using ferroelectret (also referred to as piezoelectret) polymer foam. Various embodiments include ferroelectret polymer foam within the hearing instrument as a microphone. Various embodiments include ferroelectret polymer foam within the hearing instrument but also as a momentary switch sensor.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their legal equivalents.

DETAILED DESCRIPTION

Figure 1:
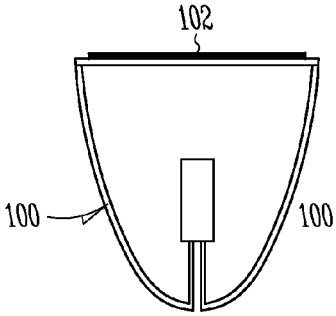
FIG. 1 illustrates a cross section of a ferroelectret foam microphone (or sensing switch) on the flat faceplate of a custom ITE hearing instrument, according to various embodiments.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This present subject matter replaces conventional microphones with thin, ferroelectret polymer foam as the transduction element. Ferroelectret foam produces a positive d33 coefficient of piezoelectricity when the thickness of the foam is decreased, which is opposite that of conventional piezoelectric polymers. Thin, ferroelectret foam has a simple construction, which allows easier integration on and/or in a hearing instrument. These ferroelectret foams are more robust to debris contamination, and multiple patches can be used to obtain directionality, e.g., in a conventional delay-and-sum configuration.

Ferroelectret polymer foam and ferroelectret fluoropolymer foam have a relatively low elastic modulus, and can therefore be easily compressed by sound waves in the audible spectrum. They have relatively high piezoelectric coefficients, thereby producing open-circuit sensitivities and equivalent noise levels equivalent to conventional hearing-instrument electret microphones. In addition, the ferrous polymer is fabricated into thin sheets of cellular foam, and can be integrated onto complex surfaces of a hearing-instrument in such a manner as to create a directional system. Lastly, if the ferrous foam becomes contaminated with debris, the debris can be wiped off without damaging the transducer or degrading its performance.

The ferroelectret foam is fabricated into very thin films from low-cost polymers, in various embodiments. The overall thickness, on the order of 0.1 mm, can easily be integrated onto the geometry of hearing instruments. This includes, but is not limited to, 1) the faceplate surface (lateral) or eartip surface (medial) of a custom ITE instrument, 2) the outer surface of a standard BTE instrument, 3) the internal shell surface of either a custom or standard instrument, 4) any surface where mechanical pressure sensing can be used to provide information for hearing instrument functionality, such as a sensor switch, or 5) any surface where an estimate for sound pressure is desired. The substrate surface does not have to be flat. Instead, the ferroelectret foam can be attached over a complex, undulating surface. The ferroelectret foam does not require a bias voltage or power supply to operate, in various embodiments.

According to various embodiments, ferroelectret foam with a thickness of about 50-500 microns is used for a hearing assistance device application. In various embodiments, multiple layers of ferroelectret film are used to provide the desired thickness. In one embodiment, four layers of ferroelectret film are used. In an embodiment, each layer is 70 microns in thickness. According to various embodiments, the foam can be formed of single or multiple laminated film layers.

In various embodiments, two patches of ferroelectret foam can be arranged separately on the faceplate surface to sense the propagating waves at different locations thereby creating a first order delay-and-sum directional system. Three or more patches of ferroelectret foam can be arranged separately on the faceplate surface to create higher-order directionality. Multiple patches of ferroelectret foam can be arranged in different patterns to refine the polar pattern of the directional system. One such pattern could be concentric chords extending outward, in an embodiment. Debris can be wiped off of the ferroelectret foam without damaging its transduction capability. A separate barrier is not needed; the ferroelectret foam is inherently robust against debris.

In general, piezoelectric materials produce a linear electrical output proportional to the force of a mechanical input. Although some common piezoelectric materials include ceramics and crystals, there has been success in fabricating piezoelectric polymers of polypropylene (PP) foam (often referred to as cellular PP) voided low-density polypropylene (LDPP) and, more recently, fluorinated ethylene propylene (FEP) and polytetrafluoroethylene (PTFE)—also known as Teflon®. It should be noted that the fabrication process itself is not the focus of the present subject matter, but rather the use of such polymer foams in hearing instruments, instead of a microphone or a momentary switch, particularly when the ferroelectret is in the form of a thin film, thin foam, or sheet. In various embodiments, a material such as mylar can be used.

The ferroelectric (LDPP) polymers referenced in this document are typically fabricated with relatively straightforward processes: aerated PP sheets are bi-axially stretched to elongate the spherical voids (gasses other than air can be used to improve transduction properties). This thin cellular foam is then subjected to a strong electric field via a corona discharge, thereby exceeding the dielectric breakdown strength of the internal gas and forcing the resulting charge into the polymer structure. The distributed charge forms macroscopic dipoles along each elongated void; when an external force is applied to the cellular foam, all dipoles interact to produce charge compensation along the outer boundaries, and thus the transducer. The output signal is therefore analogous to the change in thickness of the film/foam itself, not to the motion of the film/foam relative to some reference backplate. Stacked sheets of LDPP and FEP have been engineered with similar sensitivity as modern electret hearing instrument microphones, e.g., 10 mV/Pa. In various embodiments, the material can also be used as a momentary switch which reacts to mechanical pressure either from human contact or component contact—such as a momentary switch or as an auto ON/OFF sensor.

FIGS. 1-6 illustrate cross-sections of a ubiquitous hearing instrument (or hearing assistance device 100) with applications for the ferroelectret foam 102. The figures are inferred to represent all possible ITE/BTE/RIC hearing instruments and earmolds, including earbud nubbins for RIC applications.

FIG. 1 illustrates a cross section of a ferroelectret foam microphone (or sensing switch) on the flat faceplate of a custom ITE hearing instrument, according to various embodiments. The ferroelectret foam 102 can cover a portion of or the entire surface of the faceplate, according to various embodiments. In various embodiments, the ferroelectret polymer foam 102 has a thickness of between about 50 and 500 microns. In various embodiments, multiple layers of ferroelectret film are used to provide the desired thickness of ferroelectret polymer foam 102. Four layers of ferroelectret film are used to provide the desired thickness of ferroelectret polymer foam 102, in an embodiment. In an embodiment, each layer of film has a thickness of approximately 70 microns. The multiple layers of ferroelectret film are laminated, in one embodiment. In various embodiments, the ferroelectret polymer foam 102 can include one or more of piezoelectric polymers of polypropylene (PP) foam, a voided low-density polypropylene (LDPP), fluorinated ethylene propylene (FEP), or a polytetrafluoroethylene (PTFE). The ferroelectret polymer foam 102 is configured to be used as a momentary switch sensor, in various embodiments. The ferroelectret polymer foam can configured to be used as one or more of a transduction element (such as a microphone), a switch or a sensor (such as a momentary switch sensor), in various embodiments.

Figure 1A:
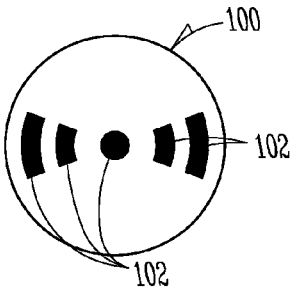
FIG. 1A illustrates a plan view of faceplate depicting multiple patches of ferrous foam separated by various distances, according to various embodiments.

FIG. 1A illustrates a plan view of faceplate depicting multiple patches of ferrous foam 102 separated by various distances, according to various embodiments. The surface area and relative polarity of the output signals from each patch can be combined to produce a higher-order directional system. Various shapes can also be used for the patches in order to adjust the spatial average of the sound pressure estimate, and thus refine the spatial characteristics of the resulting polar pattern. Other shapes and arrangements of patches can be used without departing from the scope of the present subject matter. Patches can be on more then one internal and/or external surface of the device 100, in various embodiments. In various embodiments, the hearing assistance device 100 including a ferroelectret polymer foam 102 includes arranging three or more patches of ferroelectret polymer foam on a surface of the hearing assistance device to sense propagating waves at different locations thereby creating a multiple order delay-and-sum directional system. The hearing assistance device 100 includes the three or more patches of ferroelectret polymer foam 102 arranged to refine a polar pattern of the directional system, in various embodiments. The three or more patches of ferroelectret polymer foam 102 are arranged in concentric chords extending outward, in an embodiment. The ferroelectret polymer foam can configured to be used as one or more of a transduction element (such as a microphone), a switch or a sensor (such as a momentary switch sensor), in various embodiments. Thus, in one embodiment, the foam is configured to act as a transduction element. In one embodiment, the foam is configured to act as a switch. In one embodiment, the foam is configured to act as a sensor. In one embodiment, the foam is configured to act as a transduction element and a switch. In one embodiment, the foam is configured to act as a transduction element and a sensor. In one embodiment, the foam is configured to act as a sensor and a switch. In one embodiment, the foam is configured to act as a transduction element, a sensor and a switch.

Figure 1B:
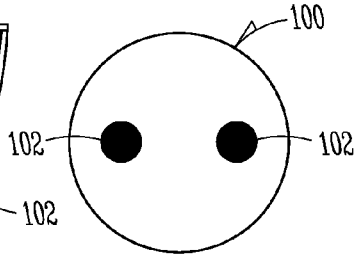
FIG. 1B illustrates a plan view of faceplate depicting two patches of ferrous foam separated by a distance, according to various embodiments.

FIG. 1B illustrates a plan view of faceplate depicting two patches of ferrous foam 102 separated by a distance, according to various embodiments. The surface areas and relative polarity of the output signals of each patch can be engineered in a conventional delay-and-sum technique to produce a first-order directional system. Non-circular shapes can also be used for the patches, in various embodiments. Other shapes and arrangements of patches can be used without departing from the scope of the present subject matter. Patches can be on more then one internal and/or external surface of the device 100, in various embodiments. In various embodiments, the hearing assistance device 100 including a ferroelectret polymer foam 102 includes arranging two patches of ferroelectret polymer foam on a surface of the hearing assistance device to sense propagating waves at different locations thereby creating a first order delay-and-sum directional system. The ferroelectret polymer foam can configured to be used as one or more of a transduction element (such as a microphone), a switch or a sensor (such as a momentary switch sensor), in various embodiments. Thus, in one embodiment, the foam is configured to act as a transduction element. In one embodiment, the foam is configured to act as a switch. In one embodiment, the foam is configured to act as a sensor. In one embodiment, the foam is configured to act as a transduction element and a switch. In one embodiment, the foam is configured to act as a transduction element and a sensor. In one embodiment, the foam is configured to act as a sensor and a switch. In one embodiment, the foam is configured to act as a transduction element, a sensor and a switch.

Figure 1C:
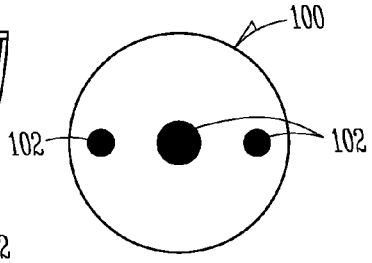
FIG. 1C illustrates a plan view of faceplate depicting three patches of ferrous foam separated by equal distance, according to various embodiments.

FIG. 1C illustrates a plan view of faceplate depicting three patches of ferrous foam 102 separated by equal distance, according to various embodiments. The surface areas and relative polarity of the output signals of each patch can be combined to produce a second-order directional system. Non-circular shapes can also be used for the patches, in various embodiments. Other shapes and arrangements of patches can be used without departing from the scope of the present subject matter. Patches can be on more then one internal and/or external surface of the device 100, in various embodiments. Similarly, more than three patches can be used to achieve higher-order directionality according to various embodiments. In various embodiments, the hearing assistance device 100 including a ferroelectret polymer foam 102 includes arranging three or more patches of ferroelectret polymer foam on a surface of the hearing assistance device to sense propagating waves at different locations thereby creating a multiple order delay-and-sum directional system. The hearing assistance device 100 includes the three or more patches of ferroelectret polymer foam 102 arranged to refine a polar pattern of the directional system, in various embodiments. The three or more patches of ferroelectret polymer foam 102 are arranged in concentric chords extending outward, in an embodiment. The ferroelectret polymer foam can configured to be used as one or more of a transduction element (such as a microphone), a switch or a sensor (such as a momentary switch sensor), in various embodiments. Thus, in one embodiment, the foam is configured to act as a transduction element. In one embodiment, the foam is configured to act as a switch. In one embodiment, the foam is configured to act as a sensor. In one embodiment, the foam is configured to act as a transduction element and a switch. In one embodiment, the foam is configured to act as a transduction element and a sensor. In one embodiment, the foam is configured to act as a sensor and a switch. In one embodiment, the foam is configured to act as a transduction element, a sensor and a switch.

Figure 2:
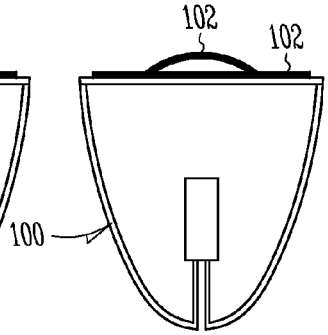
FIG. 2 is similar to FIG. 1, except that the ferroelectret foam covers the complex curved surface of the faceplate, as may be encountered with a battery drawer, according to various embodiments.

FIG. 2 is similar to FIG. 1, except that the ferroelectret foam 102 covers the complex curved surface of the faceplate, as may be encountered with a battery drawer, according to various embodiments. The ferroelectret foam 102 can cover a portion of or the entire surface of the faceplate, according to various embodiments. In various embodiments, the ferroelectret polymer foam 102 has a thickness of between about 50 and 500 microns. In various embodiments, multiple layers of ferroelectret film are used to provide the desired thickness of ferroelectret polymer foam 102. Four layers of ferroelectret film are used to provide the desired thickness of ferroelectret polymer foam 102, in an embodiment. In an embodiment, each layer of film has a thickness of approximately 70 microns. The multiple layers of ferroelectret film are laminated, in one embodiment. In various embodiments, the ferroelectret polymer foam 102 can include one or more of piezoelectric polymers of polypropylene (PP) foam, a voided low-density polypropylene (LDPP), fluorinated ethylene propylene (FEP), or a polytetrafluoroethylene (PTFE). The ferroelectret polymer foam 102 is configured to be used as a momentary switch sensor, in various embodiments. The ferroelectret polymer foam can configured to be used as one or more of a transduction element (such as a microphone), a switch or a sensor (such as a momentary switch sensor), in various embodiments. Thus, in one embodiment, the foam is configured to act as a transduction element. In one embodiment, the foam is configured to act as a switch. In one embodiment, the foam is configured to act as a sensor. In one embodiment, the foam is configured to act as a transduction element and a switch. In one embodiment, the foam is configured to act as a transduction element and a sensor. In one embodiment, the foam is configured to act as a sensor and a switch. In one embodiment, the foam is configured to act as a transduction element, a sensor and a switch.

Figure 3:
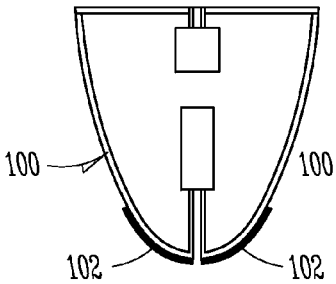
FIG. 3 illustrates a cross section of a ferroelectret foam microphone on the eartip of a conventional custom ITE hearing instrument, according to various embodiments.

FIG. 3 illustrates a cross section of a ferroelectret foam 102 microphone on the eartip of a conventional custom ITE hearing instrument, according to various embodiments. This configuration could provide an in-situ pressure measurement in the ear canal as is needed for a real-ear measurement application. The ferroelectret foam 102 can cover a portion of or the entire surface of the eartip, according to various embodiments. In various embodiments, the ferroelectret polymer foam 102 has a thickness of between about 50 and 500 microns. In various embodiments, multiple layers of ferroelectret film are used to provide the desired thickness of ferroelectret polymer foam 102. Four layers of ferroelectret film are used to provide the desired thickness of ferroelectret polymer foam 102, in an embodiment. In an embodiment, each layer of film has a thickness of approximately 70 microns. The multiple layers of ferroelectret film are laminated, in one embodiment. In various embodiments, the ferroelectret polymer foam 102 can include one or more of piezoelectric polymers of polypropylene (PP) foam, a voided low-density polypropylene (LDPP), fluorinated ethylene propylene (FEP), or a polytetrafluoroethylene (PTFE). The ferroelectret polymer foam 102 is configured to be used as a momentary switch sensor, in various embodiments. The ferroelectret polymer foam can configured to be used as one or more of a transduction element (such as a microphone), a switch or a sensor (such as a momentary switch sensor), in various embodiments. Thus, in one embodiment, the foam is configured to act as a transduction element. In one embodiment, the foam is configured to act as a switch. In one embodiment, the foam is configured to act as a sensor. In one embodiment, the foam is configured to act as a transduction element and a switch. In one embodiment, the foam is configured to act as a transduction element and a sensor. In one embodiment, the foam is configured to act as a sensor and a switch. In one embodiment, the foam is configured to act as a transduction element, a sensor and a switch.

Figure 4:
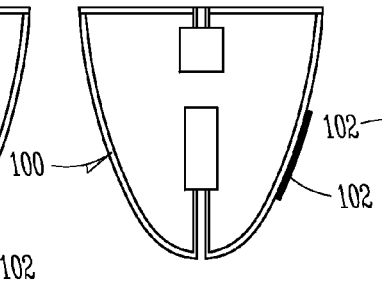
FIG. 4 illustrates a cross section of a ferroelectret foam auto ON/OFF switch integrated on the medial surface of a custom ITE hearing instrument, according to various embodiments.

FIG. 4 illustrates a cross section of a ferroelectret foam 102 auto ON/OFF switch integrated on the medial surface of a custom ITE hearing instrument, according to various embodiments. This configuration could detect pressure from the skin on the ear canal wall for auto ON/OFF applications. In various embodiments, the ferroelectret polymer foam 102 has a thickness of between about 50 and 500 microns. In various embodiments, multiple layers of ferroelectret film are used to provide the desired thickness of ferroelectret polymer foam 102. Four layers of ferroelectret film are used to provide the desired thickness of ferroelectret polymer foam 102, in an embodiment. In an embodiment, each layer of film has a thickness of approximately 70 microns. The multiple layers of ferroelectret film are laminated, in one embodiment. In various embodiments, the ferroelectret polymer foam 102 can include one or more of piezoelectric polymers of polypropylene (PP) foam, a voided low-density polypropylene (LDPP), fluorinated ethylene propylene (FEP), or a polytetrafluoroethylene (PTFE). The ferroelectret polymer foam can configured to be used as one or more of a transduction element (such as a microphone), a switch or a sensor (such as a momentary switch sensor), in various embodiments. Thus, in one embodiment, the foam is configured to act as a transduction element. In one embodiment, the foam is configured to act as a switch. In one embodiment, the foam is configured to act as a sensor. In one embodiment, the foam is configured to act as a transduction element and a switch. In one embodiment, the foam is configured to act as a transduction element and a sensor. In one embodiment, the foam is configured to act as a sensor and a switch. In one embodiment, the foam is configured to act as a transduction element, a sensor and a switch.

Figure 5:
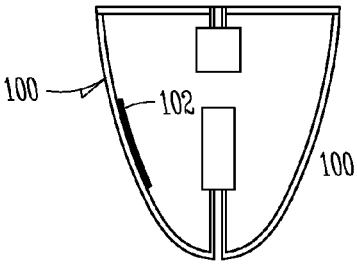
FIG. 5 illustrates a cross section of a ferroelectret foam microphone integrated on the internal surface of a conventional custom ITE hearing instrument, according to various embodiments.

FIG. 5 illustrates a cross section of a ferroelectret foam 102 microphone integrated on the internal surface of a conventional custom ITE hearing instrument, according to various embodiments. Although not shown in the figure, the custom shell could be vented or dual vented. This configuration could detect sound pressure anywhere within the instrument for acoustic and/or adaptive feedback control. The ferroelectret foam 102 can cover a portion of or the entire internal surface, according to various embodiments. In various embodiments, the ferroelectret polymer foam 102 has a thickness of between about 50 and 500 microns. In various embodiments, multiple layers of ferroelectret film are used to provide the desired thickness of ferroelectret polymer foam 102. Four layers of ferroelectret film are used to provide the desired thickness of ferroelectret polymer foam 102, in an embodiment. In an embodiment, each layer of film has a thickness of approximately 70 microns. The multiple layers of ferroelectret film are laminated, in one embodiment. In various embodiments, the ferroelectret polymer foam 102 can include one or more of piezoelectric polymers of polypropylene (PP) foam, a voided low-density polypropylene (LDPP), fluorinated ethylene propylene (FEP), or a polytetrafluoroethylene (PTFE). The ferroelectret polymer foam 102 is configured to be used as a momentary switch sensor, in various embodiments. The ferroelectret polymer foam can configured to be used as one or more of a transduction element (such as a microphone), a switch or a sensor (such as a momentary switch sensor), in various embodiments. Thus, in one embodiment, the foam is configured to act as a transduction element. In one embodiment, the foam is configured to act as a switch. In one embodiment, the foam is configured to act as a sensor. In one embodiment, the foam is configured to act as a transduction element and a switch. In one embodiment, the foam is configured to act as a transduction element and a sensor. In one embodiment, the foam is configured to act as a sensor and a switch. In one embodiment, the foam is configured to act as a transduction element, a sensor and a switch.

Figure 6:
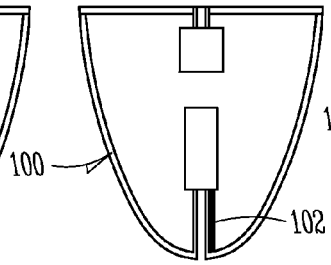
FIG. 6 illustrates a cross section of a ferroelectret foam microphone integrated on the internal surface of the tube of a conventional custom ITE hearing instrument receiver, according to various embodiments.

FIG. 6 illustrates a cross section of a ferroelectret foam 102 microphone integrated on the internal surface of the tube of a conventional custom ITE hearing instrument receiver, according to various embodiments. This configuration could provide a sound pressure measurement at the exit of the receiver, regardless of the acoustical load. The ferroelectret foam 102 can cover a portion of or the entire surface of the faceplate, according to various embodiments. In various embodiments, the ferroelectret polymer foam 102 has a thickness of between about 50 and 500 microns. In various embodiments, multiple layers of ferroelectret film are used to provide the desired thickness of ferroelectret polymer foam 102. Four layers of ferroelectret film are used to provide the desired thickness of ferroelectret polymer foam 102, in an embodiment. In an embodiment, each layer of film has a thickness of approximately 70 microns. The multiple layers of ferroelectret film are laminated, in one embodiment. In various embodiments, the ferroelectret polymer foam 102 can include one or more of piezoelectric polymers of polypropylene (PP) foam, a voided low-density polypropylene (LDPP), fluorinated ethylene propylene (FEP), or a polytetrafluoroethylene (PTFE). The ferroelectret polymer foam 102 is configured to be used as a momentary switch sensor, in various embodiments. The ferroelectret polymer foam can configured to be used as one or more of a transduction element (such as a microphone), a switch or a sensor (such as a momentary switch sensor), in various embodiments. Thus, in one embodiment, the foam is configured to act as a transduction element. In one embodiment, the foam is configured to act as a switch. In one embodiment, the foam is configured to act as a sensor. In one embodiment, the foam is configured to act as a transduction element and a switch. In one embodiment, the foam is configured to act as a transduction element and a sensor. In one embodiment, the foam is configured to act as a sensor and a switch. In one embodiment, the foam is configured to act as a transduction element, a sensor and a switch.

One aspect of the present subject matter includes a hearing assistance device including ferroelectret polymer foam. In one embodiment, the foam is configured to act as a transduction element, such as a microphone. In another embodiment, the foam is configured to act as a sensor, such as a pressure or momentary switch sensor. Other types of sensors can be configured using the foam without departing from the scope of the present subject matter. In yet another embodiment, the foam is configured to act as a switch, such as a momentary switch. Other types of switches can be configured using the foam without departing from the scope of the present subject matter. In various embodiments, the foam is configured to act as more than one of a transduction element, a sensor, and/or a switch. In various embodiments, the foam is formed or applied in separate patches. The separate patches of foam can act as one or more of a transduction element, a sensor, and/or a switch, in various embodiments. In various embodiments, the ferroelectret polymer foam has a thickness of between about 50 and 500 microns. In various embodiments, multiple layers of ferroelectret film are used to provide the desired thickness of ferroelectret polymer foam. Four layers of ferroelectret film are used to provide the desired thickness of ferroelectret polymer foam, in an embodiment. In an embodiment, each layer of film has a thickness of approximately 70 microns. The multiple layers of ferroelectret film are laminated, in one embodiment. In various embodiments, the ferroelectret polymer foam can include one or more of piezoelectric polymers of polypropylene (PP) foam, a voided low-density polypropylene (LDPP), fluorinated ethylene propylene (FEP), or a polytetrafluoroethylene (PTFE). The ferroelectret polymer foam 102 is configured to be used as a momentary switch sensor, in various embodiments.

One aspect of the present subject matter includes a method including forming a hearing assistance device including a ferroelectret polymer foam. In various embodiments, the ferroelectret polymer foam has a thickness of between about 50 and 500 microns. Forming a hearing assistance device includes forming an in-the-ear (ITE) hearing assistance device, in various embodiments. Forming an in-the-ear (ITE) hearing assistance device including ferroelectret polymer foam includes integrating the ferroelectret polymer foam on a faceplate surface of the ITE hearing assistance device, in an embodiment. The faceplate surface includes a lateral faceplate surface, and the surface can be flat or undulating (non-flat), in various embodiments. In various embodiments, forming an in-the-ear (ITE) hearing assistance device including ferroelectret polymer foam includes integrating the ferroelectret polymer foam on an eartip surface of the ITE hearing assistance device. The eartip surface includes a medial eartip surface, in an embodiment. Forming an in-the-ear (ITE) hearing assistance device includes integrating the ferroelectret polymer foam on an inner surface of a housing of the ITE hearing assistance device, in various embodiments.

In various embodiments, forming a hearing assistance device includes forming a behind-the-ear (BTE) hearing assistance device. Forming a behind-the-ear (BTE) hearing assistance device includes integrating the ferroelectret polymer foam on an outer surface, an inner surface or both an inner and outer surface of the BTE hearing assistance device, in various embodiments. The foam can be applied to a flat surface of the BTE, or an undulating (non-flat) surface of the BTE, in various embodiments.

In various embodiments, forming a hearing assistance device including ferroelectret polymer foam includes arranging two patches of ferroelectret polymer foam on a surface of the hearing assistance device to sense propagating waves at different locations thereby creating a first order delay-and-sum directional system. In various embodiments, forming a hearing assistance device including ferroelectret polymer foam includes arranging three or more patches of ferroelectret polymer foam on a surface of the hearing assistance device to sense propagating waves at different locations thereby creating a multiple order delay-and-sum directional system. Forming the hearing assistance device includes arranging the three or more patches of ferroelectret polymer foam to refine a polar pattern of the directional system, in various embodiments. Arranging the three or more patches of ferroelectret polymer foam includes arranging the patches in concentric chords extending outward, in an embodiment. As stated above, the ferroelectret polymer foam can configured to be used as one or more of a transduction element (such as a microphone), a switch or a sensor (such as a momentary switch sensor), in various embodiments.

The present subject matter provides for many benefits, including but not limited to: introducing a new form factor for microphone and/or momentary switch integration; allowing the microphone or switch to reside on the exterior of the hearing instrument, without the need of an orifice, conduit, or any other penetration; reducing the amount of space within the hearing instrument required for microphones and/or switches; increasing the robustness of the hearing instrument's microphone; increasing the robustness of the hearing instrument's momentary switch; reducing the rate of return due to microphone failure; and reducing the rate of return due to switch failure.

The present subject matter can be used for a variety of hearing assistance devices, including but not limited to, assistive listening devices, tinnitus masking devices, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, such as receiver-in-the-canal (RIC) or receiver-in-the-ear (RITE) designs. It is understood that other hearing assistance devices not expressly stated herein may fall within the scope of the present subject matter.

CONCLUSION

This application is intended to cover adaptations or variations of the present subject matter. It is to be understood that the above description is intended to be illustrative, and not restrictive. Thus, the scope of the present subject matter is determined by the appended claims and their legal equivalents.

What is claimed is:

1. A hearing assistance device configured to be worn by a wearer, comprising:

a transduction element including ferroelectret polymer foam, wherein the ferroelectret polymer foam is configured to include patches arranged in concentric chords extending outward on a surface of the hearing assistance device to sense propagating sound waves at different locations.

2. The hearing assistance device of claim 1, wherein the ferroelectret polymer foam has a thickness of between about 50 and 500 microns.

3. The hearing assistance device of claim 1, wherein multiple layers of ferroelectret film are used to provide the desired thickness of ferroelectret polymer foam.

4. The hearing assistance device of claim 3, wherein four layers of ferroelectret film are used to provide the desired thickness of ferroelectret polymer foam.

5. The hearing assistance device of claim 3, wherein each layer has a thickness of approximately 70 microns.

6. The hearing assistance device of claim 3, wherein the multiple layers of ferroelectret film are laminated.

7. The hearing assistance device of claim 1, wherein the ferroelectret polymer foam includes piezoelectric polymers of polypropylene (PP) foam.

8. The hearing assistance device of claim 1, wherein the ferroelectret polymer foam includes voided low-density polypropylene (LDPP).

9. The hearing assistance device of claim 1, wherein the ferroelectret polymer foam includes fluorinated ethylene propylene (FEP).

10. The hearing assistance device of claim 1, wherein the ferroelectret polymer foam includes polytetrafluoroethylene (PTFE).

11. The hearing assistance device of claim 1, wherein the ferroelectret polymer foam is configured to be used as a momentary switch sensor.

12. A method, comprising:

forming a hearing assistance device configured to be worn by a wearer including a ferroelectret polymer foam, including arranging patches of ferroelectret polymer foam in concentric chords extending outward on a surface of the hearing assistance device to sense propagating sound waves at different locations to refine a polar pattern of the sensed sound waves.

13. The method of claim 12, wherein the ferroelectret polymer foam has a thickness of between about 50 and 500 microns.

14. The method of claim 12, wherein forming a hearing assistance device includes forming an in-the-ear (ITE) hearing assistance device.

15. The method of claim 14, wherein forming an in-the-ear (ITE) hearing assistance device including a ferroelectret polymer foam includes integrating the ferroelectret polymer foam on a faceplate surface of the ITE hearing assistance device.

16. The method of claim 15, wherein the faceplate surface includes a lateral faceplate surface.

17. The method of claim 15, wherein the faceplate surface is flat.

18. The method of claim 15, wherein the faceplate surface is undulating.

19. The method of claim 14, wherein forming an in-the-ear (ITE) hearing assistance device including a ferroelectret polymer foam includes integrating the ferroelectret polymer foam on an eartip surface of the ITE hearing assistance device.

20. The method of claim 19, wherein the eartip surface includes a medial eartip surface.

21. The method of claim 14, wherein forming an in-the-ear (ITE) hearing assistance device includes integrating the ferroelectret polymer foam on an inner surface of a housing of the ITE hearing assistance device.

22. The method of claim 12, wherein forming a hearing assistance device including a ferroelectret polymer foam includes arranging two patches of ferroelectret polymer foam on a surface of the hearing assistance device to sense propagating waves at different locations thereby creating a first order delay-and-sum directional system.

23. The method of claim 12, wherein forming a hearing assistance device including a ferroelectret polymer foam includes arranging three or more patches of ferroelectret polymer foam on a surface of the hearing assistance device to sense propagating waves at different locations thereby creating a multiple order delay-and-sum directional system.

24. The method of claim 23, wherein forming the hearing assistance device includes arranging the three or more patches of ferroelectret polymer foam to refine a polar pattern of the directional system.

25. The method of claim 24, wherein arranging the three or more patches of ferroelectret polymer foam includes arranging the patches in concentric chords extending outward.

26. The method of claim 12, wherein the ferroelectret polymer foam is configured to be used as a momentary switch sensor.

27. The method of claim 12, wherein the ferroelectret polymer foam is configured to be used as a microphone.

* * * * *